US005318050A

United States Patent [19]

Gonzalez-Parra et al.

[11] Patent Number: 5,318,050

[45] Date of Patent: Jun. 7, 1994

[54] TOBACCO TREATMENT PROCESS

[75] Inventors: Alvaro Gonzalez-Parra, Clemmons; Thomas A. Perfetti, Winston-Salem; Jackie L. White, Pfafftown, all of N.C.

[73] Assignee: R. J. Reynolds Tobacco Company, Winston-Salem, N.C.

[21] Appl. No.: 992,566

[22] Filed: Dec. 18, 1992

Related U.S. Application Data

[63] Continuation of Ser. No. 717,457, Jun. 19, 1991, abandoned, which is a continuation-in-part of Ser. No. 710,273, Jun. 4, 1991, Pat. No. 5,159,942.

[51] Int. Cl.[5] ..... A24B 15/24; A24B 15/26

[52] U.S. Cl. ..... 131/297; 131/290; 131/298

[58] Field of Search ..... 131/297, 298, 290, 300, 131/308-310

[56] References Cited

U.S. PATENT DOCUMENTS

| | | |
|---|---|---|
| 3,174,485 | 3/1965 | Griffith et al. . |
| 3,316,919 | 5/1967 | Green et al. . |
| 3,398,754 | 8/1968 | Tughan . |
| 3,424,171 | 1/1969 | Rooker . |
| 3,803,004 | 4/1974 | Egri . |
| 3,894,543 | 7/1975 | Anderson et al. . |
| 4,150,677 | 4/1979 | Osborne, Jr. et al. . |
| 4,244,381 | 1/1981 | Lendvay . |
| 4,256,123 | 3/1981 | Lendvay et al. . |
| 4,497,330 | 2/1985 | Banyask et al. . |
| 4,506,682 | 3/1985 | Muller . |
| 4,596,259 | 6/1986 | White et al. . |
| 4,607,646 | 8/1986 | Lilly, Jr. et al. . |
| 4,638,816 | 8/1987 | Cox et al. . |
| 4,714,082 | 12/1987 | Banerjee et al. . |
| 4,744,375 | 5/1988 | Denier et al. . |
| 4,756,318 | 7/1988 | Clearman et al. . |
| 4,793,365 | 12/1988 | Sensabaugh, Jr. et al. . |
| 4,819,668 | 4/1989 | Shelar et al. . |
| 4,825,884 | 5/1989 | Denier et al. . |
| 4,827,949 | 5/1989 | Sunas . |
| 4,986,286 | 1/1991 | Roberts et al. . |
| 5,016,654 | 5/1991 | Bernasek et al. . |
| 5,060,669 | 10/1991 | White et al. . |
| 5,099,862 | 3/1992 | White et al. ..... 131/308 X |

OTHER PUBLICATIONS

Roeraade, et al., J. Agr. Food Chem. vol. 20, No. 5, p. 1035 (1972).

Johnson, et al., 18th tob. Chem. Res. Conf. (1964).

*Primary Examiner*—Jennifer Doyle

*Attorney, Agent, or Firm*—Bell Seltzer Park & Gibson

[57] ABSTRACT

Flavorful tobacco extracts are provided by subjecting a moist spray dried tobacco extract to heat treatment. The moist extract is contacted with a furanone, a pyranone or an alpha-dicarbonyl compound, and exposed to a temperature above about 100° C. in a pressure controlled vessel. Resulting flavorful extracts are useful as forms of tobacco in cigarettes and other smoking articles.

24 Claims, 1 Drawing Sheet

TOBACCO TREATMENT PROCESS

CROSS REFERENCE TO RELATED APPLICATION

This is a continuation of U.S. Pat. application Ser. No. 07/717,457, filed Jun. 19, 1991, now abandoned, which is a continuation-in-part of U.S. Pat. application Ser. No. 710,273, filed Jun. 4, 1991, now U.S. Pat. No. 5,159,942, the disclosure of which is incorporated herein by reference.

BACKGROUND OF THE INVENTION

The present invention relates to flavorful forms of tobacco for cigarettes and other types of smoking articles, and in particular, to processes for providing such flavorful forms of tobacco.

Popular smoking articles, such as cigarettes, have a substantially cylindrical rod shaped structure and include a charge of smokable material, such as shreds or strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material. Many cigarettes include processed tobacco materials and/or tobacco extracts in order to provide certain flavorful characteristics to those cigarettes.

Many types of smoking products and improved smoking articles have been proposed through the years as improvements upon, or as alternatives to, the popular smoking articles. Recently, U.S. Pat. Nos. 4,708,151 to Shelar; 4,714,082 to Banerjee, et al.; 4,756,318 to Clearman, et al.; 4,793,365 to Sensabaugh, Jr., et al.; 4,854,311 to Banerjee, et al.; 4,881,556 to Clearman, et al.; and 5,027,837 to Clearman, et al., propose cigarettes and pipes which comprise a fuel element, an aerosol generating means physically separate from the fuel element, and a separate mouthend piece. Such types of smoking articles provide natural tobacco flavors to the smoker thereof by heating, without necessarily burning, tobacco in various forms. As natural tobacco flavors are important components of smoking articles in order that such smoking articles can provide adequate tobacco taste and aroma, improved processes for providing natural tobacco flavor substances and flavorful forms of tobacco are desirable.

It would be highly desirable to provide a process for efficiently and effectively producing flavorful forms of tobacco.

SUMMARY OF THE INVENTION

The present invention relates to a process for providing flavorful natural tobacco substances which are useful forms of tobacco for various types of cigarettes and other smoking articles. In particular, a tobacco extract is subjected to heat treatment (i.e., a moderately high temperature treatment) under conditions sufficient to alter the chemical nature (e.g., the flavor and aroma characteristics) of the extract. Normally, the tobacco extract is exposed to a temperature sufficiently high and for a period of time sufficiently long so as to provide an extract which does not exhibit a "green" or harsh flavor. However, it is preferable that the tobacco extract not be exposed to such a high temperature for a sufficiently long period of time so as to provide an extract which exhibits a burnt, tarry, overly bitter or highly metallic flavor.

The tobacco extract is combined with an aqueous liquid to form a moist extract, and can be carried by a substrate during the time that the extract undergoes the moderately high temperature treatment. In addition, moist tobacco extract can be combined with an organic liquid (e.g., glycerin) to form a moist extract/organic liquid mixture prior to the time that the tobacco extract is subjected to the moderately high temperature treatment. Thus, for purposes of the present invention, it is convenient to refer to the heat treatment, or the moderately high temperature treatment, of a tobacco composition. For purposes of this invention, a tobacco composition can include (i) a tobacco extract, additive and an aqueous liquid, (ii) a tobacco extract, additive, an aqueous liquid, and a substrate which carries the extract and aqueous liquid, (iii) a tobacco extract, additive, an aqueous liquid and an organic liquid, or (iv) a tobacco extract, additive, an aqueous liquid, an organic liquid and a substrate for the extract and liquids.

The additive which is contacted or combined with the tobacco extract for processing according to the present invention is a non-sugar compound capable of reacting with ammonia, ammonia releasing compounds, amides, amines or amino acids to provide Browning or Maillard reaction products. Such an additive normally has active carbonyl or alcohol functionalities which are capable of reacting with compound containing a nitrogen-containing functionality to produce Browning or Maillard reaction products. If desired, further additives including at least one sugar and/or at least one amino acid can be incorporated into the tobacco composition.

More particularly, the present invention relates to a process for treating natural tobacco substances by subjecting a tobacco extract (e.g., an aqueous tobacco extract) and a non-sugar additive having a functionality capable of reacting with an amino acid to exposure to a temperature above about 100° C. The tobacco extract has a moisture content of at least about 5 weight percent, preferably at least about 15 weight percent, when that extract and additive are exposed to the moderately high temperature treatment; and that moist tobacco extract and additive are subjected to such treatment while enclosed in a pressure controlled environment. In general, the pressure experienced by the extract and additive is greater than ambient (i.e., atmospheric) pressure; and typically, that pressure exceeds 100 psig at some point during the treatment. For purposes of this invention, the term "moisture content" relates to the weight of the water within the tobacco composition relative to the total weight of the tobacco composition. The tobacco extract and additive normally are subjected to such treatment in order that the entire composition is exposed to a temperature above about 100° C. for at least about 10 minutes.

The flavorful tobacco substances so provided are useful as forms of tobacco for smoking products. For example, such flavorful tobacco substances are useful as casing or top dressing components for tobacco laminae and cut filler, as well as for other smokable materials. Such flavorful tobacco substances can be employed as a form of tobacco in those types of smokable materials described in European Patent Application No. 419,733. Alternatively, such flavorful tobacco substances are useful as one form of tobacco employed in those types of smoking articles described in U.S. Pat. Nos. 4,708,151 to Shelar; 4,714,082 to Banerjee, et al.; 4,756,318 to Clearman, et al.; 4,793,365 to Sensabaugh, et al.; 4,819,665 to Roberts, et al.; 4,854,311 to Banerjee, et al.; 4,881,556 to Clearman, et al.; 4,991,596 to Lawrence, et al.; and 5,027,837 to Clearman, et al.; U.S. Pat. application Ser. No. 642,233, filed Jan. 23, 1991; and European Patent Application No. 342,538. The flavorful tobacco substances are useful as cigarette filter additives. For example, the flavorful tobacco substances can be incorporated into low density polyethylene and formed into strands; and then incorporated into cigarette filters as described in U.S. Pat. Nos. 4,281,671 to Bynre, et al. and 4,862,905 to Green, Jr., et al. The flavorful tobacco substances are also useful forms of tobacco in those smoking articles described in U.S. Pat. application Ser. No. 621,499, filed Dec. 7, 1990. The flavorful tobacco substances also are useful as cigarette wrapper additives; or as additives to the inner regions of cigarette packages (e.g., within a paper/foil laminate of a cigarette package or within a low density polyethylene film which is placed within a cigarette aroma and "pack aroma." See also, U.S. Pat. application Ser. No. 696,700, filed May 7, 1991.

DETAILED DESCRIPTION OF THE PREFERRED EMBODIMENTS

Figure 1:
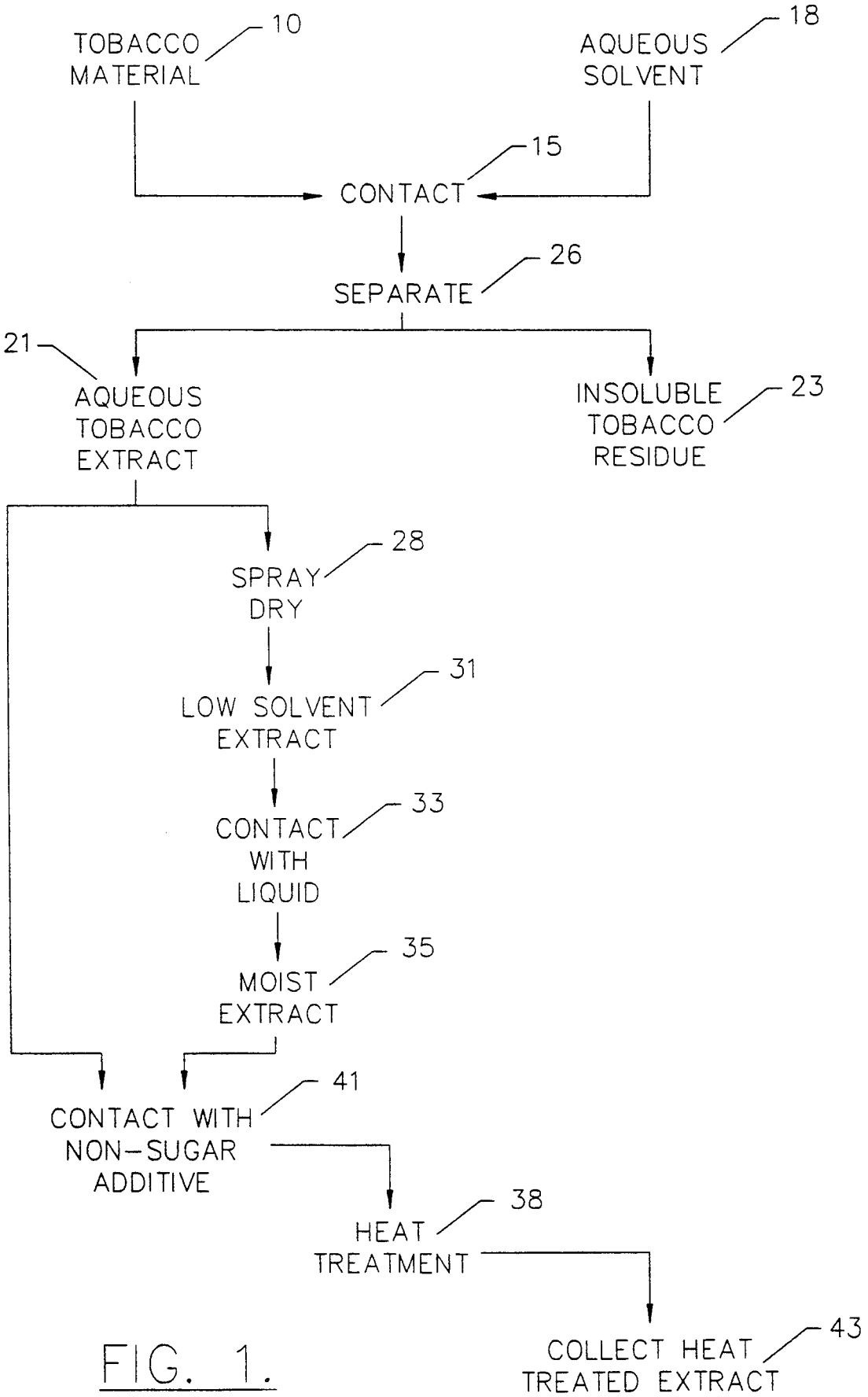
FIG. 1 is a schematic diagram of process steps representative of embodiments of the present invention.

Referring to FIG. 1, tobacco material 10 is contacted 15 with an extraction solvent 18 having an aqueous character. As such, various soluble components are extracted from the tobacco material 10 yielding an aqueous tobacco extract 21 and a water insoluble tobacco residue 23. The aqueous (i.e., liquid) tobacco extract 21 is separated 26 from the insoluble residue 23 using centrifugation techniques, or the like. The tobacco extract components can be separated from the solvent by distillation techniques followed by spray drying techniques 28, or the like. Alternatively, the liquid extract can be employed as such. The resulting isolated tobacco extract 31 is in a relatively low solvent form. The extract 31 then is contacted 33 with a liquid having an aqueous character, such that a moist tobacco extract 35 is provided. The moist tobacco extract (or the aqueous tobacco extract) is subjected to a moderately high temperature treatment 38 in an enclosed, pressure controlled environment in the presence of a non-sugar additive 41 capable of reacting with a nitrogen functionality of a nitrogen-containing compound for a period of time sufficient to provide desirable flavor characteristics to the extract. The resulting heat-treated extract then is collected 43 for later use in the manufacture of cigarettes and other smoking articles.

The tobacco materials useful herein can vary. Tobacco materials which are used are of a form such that, under extraction conditions, a portion thereof if soluble in (i.e., extracted by) an extraction solvent; and a portion thereof is insoluble in (i.e., not extracted by) that extraction solvent. Examples of suitable types of tobaccos include flue-cured, Burley, Md. and Oriental tobaccos, as well as the rare or specialty tobaccos. The tobacco material generally has been aged, and can be in the form of laminae and/or stem, or can be in processed form. Tobacco waste materials and processing by-products such as fines, dust, scrap, stems and stalks can be employed. The aforementioned tobacco materials can be processed separately, or as blends thereof. Burley tobacco material or blends of tobacco materials including Burley tpbacco material are particularly preferred.

A tobacco extract can be provided in a number of ways. In particular, the tobacco material is subjected to extraction conditions with a suitable solvent to extract a sufficient amount of the desired components from the tobacco material. The manner in which the tobacco material is extracted, and the type of solvent employed, can vary. For example, the tobacco material can be extracted using organic solvents (e.g., hexane, methanol or ethanol), halocarbons and halogenated hydrocarbons, supercritical fluids (e.g., supercritical carbon dioxide and supercritical sulfur hexafluoride), and the like. Tobacco extracts can be provided by contacting a tobacco material with ammonia and steam under extraction conditions, as described in U.S. Pat. application Ser. No. 710,273, filed Jun. 4, 1991. Preferably, the tobacco extract is provided by extracting the tobacco material using a liquid having an aqueous character. Such a liquid consists primarily of water, normally greater than about 90 weight percent water, and can be essentially pure water in certain circumstances. For example, a solvent having an aqueous character can be distilled water, tap water, or the like. However, a solvent having an aqueous character can include water having substances such as pH buffers, pH adjusters, organic and inorganic salts, sugars, amino acids or surfactants incorporated therein. The solvent also can be a co-solvent mixture of water and minor amounts of one or more solvents which are miscible therewith.

Methods for extracting components from tobacco materials, separating extracts from unextracted tobacco materials, and isolating tobacco extracts will be apparent to the skilled artisan. If desired, the extraction can be performed in the presence of active enzymes which digest or decompose components of the biopolymer matrix of the tobacco material.

The tobacco extract can have various forms. For example, it is desirable to subject an aqueous extract to a spray drying, freeze drying, belt drying, flash drying, or other suitable solvent removal process in order to provide a tobacco extract in a substantially solvent-free form. As such, tobacco extracts can have the form of a paste, a viscous liquid, a powder, a granular solid, a gel, or the like. Tobacco extracts can be processed as described in U.S. Pat. No. 5,005,593 to Fagg; European Patent Application No. 338,831; as well as U.S. Pat. application Ser. No. 680,207 filed Apr. 4, 1991. Typically, tobacco extracts are provided in the form of spray dried extracts, freeze dried extracts, tobacco essences, or the like.

For purposes of this invention, spray drying is a one-step continuous process for removing a liquid from a solution and producing a dried particulate form of the extracted components within the solution by spraying a feed of the solution into a hot drying medium. Representative spray drying processes are described in U.S. Pat. Nos. 3,398,754 to Tughan and 5,005,593 to Fagg. For purposes of this invention, freeze drying is an indirect, batch or continuous process for removing the liquid from a solution and producing a dried form of the extracted components by freezing the solution and drying the solution in a frozen state through sublimation under high vacuum. A representative freeze drying process is described in U.S. Pat. No. 3,316,919 to Green. Methods and conditions for providing extracted materials in a solid form (e.g., as a powder) will be apparent to the skilled artisan.

The extracted tobacco components can be provided at a predetermined solvent level (e.g., in a predetermined high moisture form) by evaporating the solvent from the mixture of solvent and extract. Vacuum distillation and thin film evaporation techniques are particularly preferred.

The tobacco extract is in contact with an aqueous liquid in order to provide a moist extract. Certain tobacco extracts which are extracted using an aqueous liquid may have a significant moisture content, and do not require further addition of aqueous liquid thereto. The manner of contacting a low moisture content tobacco extract with the aqueous liquid can vary and is not particularly critical. Typically, the extract and liquid are mixed using stirring or agitation, and often employing gentle heating.

The amount of water relative to the tobacco extract (i.e., the moisture content of the moist tobacco extract) can vary when the heat treatment step of the process of the present invention is performed. Typically, the moisture content of the extract is at least about 5 weight percent, normally at least about 15 weight percent, and frequently at least about 25 weight percent. Normally, the moisture content of the moist tobacco extract does not exceed about 90 weight percent, and frequently does not exceed about 80 weight percent.

The moist tobacco extract can be contacted with a substrate. Preferred substrates are normally solid materials and are thermally stable at those temperatures experienced during the heat treatment steps of the present invention. Examples of suitable substrate materials include porous carbons, carbon fibers, carbon yarns, high surface area glass beads, aluminas, clays, and the like. Typical substrates are aluminas available as D-2 Sintered Alpha Alumina from W. R. Grace & Co. and carbon yarns available as Kynol Catalogue No. CFY-020Y-3 from American Kynol, Inc. Furthermore, the moist tobacco extract can be contacted with an organic liquid. Examples of organic liquids include polyhydric alcohols (e.g., glycerin and propylene glycol).

An additive is contacted or otherwise combined with the tobacco extract. The additive is a non-sugar compound capable of reaction with a compound containing a nitrogen-containing functionality to provide a Browning or Maillard reaction product. Examples of such compounds containing nitrogen-containing functionalities include ammonia, ammonia releasing compounds (e.g., ammonium carbonate), amides, amines, amino acids and amino acid analogues. Examples of suitable additives are certain reaction products or reaction intermediates of the Maillard reaction. Suitable additives are carbonyl compounds (e.g., aldehydes and ketones); anhydrides; lactones; alcohols and the like. Examples of additives include levulinic acid, furanones (e.g. 4-hydroxy-3(2H),-furanones such as furaneol), pyranones (e.g., 3-hydroxy-4H-Pyran-4-ones such as maltol), alpha-dicarbonyl compounds (e.g., 2,3- pentanedione or 2,3-butanedione), and the like. The amount of additive employed can vary, but generally ranges from about 1 to about 10, preferably about 1.5 to about 5 percent, based on the total weight of the tobacco composition which is subjected to the heat treatment. Typically, the amount of additive ranges from about 3 to about 15, preferably about 5 to about 10 percent, based on the dry weight of the tobacco extract.

If desired, further flavoring agents (e.g., cocoa, licorice, St. John's bread, spices, herbs, and the like) can be added to, or combined with, the tobacco extract. Certain amounts of sugars (e.g., fructose, sucrose, glucose, maltose) can be added to the tobacco extract. Certain amounts of amino acids and amino acid analogs (e.g., glutamine, asparagine, proline, alanine, cystine, aspartic acid, phenylalanine, glutamic acid) can be added to the tobacco extract. If desired, sugars as well as amino acids or amino acid analogs can be added to a tobacco extract. See, U.S. Pat. application Ser. Nos. 452,175, filed Dec. 18, 1989, and 536,250, filed Jun. 11, 1990, which are incorporated herein by reference.

The tobacco composition is subjected to moderately high temperature treatment. Typically, such treatment involves exposing the tobacco composition to a temperature above about 100° C., preferably above about 110° C., and more preferably above about 120° C. However, it is desirable to subject the tobacco composition to a temperature below about 250° C., more desirably below about 200° C., in order to avoid an undesirable formation of components which are deleterious to the taste characteristics of the tobacco composition.

The moderately high temperature treatment of the tobacco composition can be performed under an inert atmosphere. For example, nitrogen and argon gas can be employed in order to provide an inert atmosphere. However, the heat treatment can be conducted under ambient atmosphere. (i.e., air).

The moderately high temperature treatment is performed in a pressure controlled environment. Such an environment is provided by enclosing the tobacco composition in an air sealed vessel or chamber. Typically, a pressure controlled environment is provided using a pressure vessel or chamber which is capable of withstanding relatively high pressures. Such vessels or chambers (i) provide enclosure or concealment of the tobacco composition such that volatile flavor components of the tobacco extract are not lost or do not otherwise escape during the moderately high temperature treatment step, and (ii) provide for treatment of the tobacco composition at a temperature significantly above about 100° C. Preferred pressure vessels are equipped with an external heating source. Examples of vessels which provide a pressure controlled environment include a Parr Reactor Model No. 4522 and a Parr Reactor Model No. 4552 available from The Parr Instrument Co. Operation of such exemplary vessels will be apparent to the skilled artisan. Typical pressures experienced by the tobacco composition during the process of the present invention range from about 10 psig to about 1,000 psig, normally from about 20 psig to about 500 psig. Pressures experienced by the tobacco composition typically exceed 100 psig during the process of the present invention.

The amount of time that the tobacco composition is subjected to the moderately high temperature treatment can vary. Normally, the time period is sufficient to heat an entire tobacco composition at the desired temperature for a period of at least about 10 minutes, preferably at least about 20 minutes. Normally, the time period is less than about 3 hours, preferably less than about 1 hour. However, it is desirable to control the time/temperature profile o tobacco compositions subjected to heat treatment so that each tobacco composition is not subjected to a particularly high temperature for a lengthy period of time. It is highly desirable to employ a pressure vessel design or a vessel equipped with an agitation mechanism such that the tobacco composition experiences a relatively uniform temperature throughout the treatment period. In particular, it is highly desirable for the entire tobacco composition to be heated uniformly throughout as much as possible at the maximum temperature to which the tobacco composition is subjected.

Conditions provided during the process of the present invention most desirably are such that certain components of the tobacco extract undergo Maillard or Browning Reactions. Such reactions are reactions between (i) the amino substituents of amino acids, peptides, proteins or the nitrogen-containing functionalities of other nitrogen-containing compounds, and (ii) the carbonyl group of a sugar in the reducing form, other carbonyl-containing compounds or the non-sugar additives of the present invention. Such reactions result in a significant darkening of the tobacco extract, typically to an extremely dark brown color. Such reactions often result in a moist tobacco extract of increased viscosity, particularly when the extract is subjected to relatively high temperature treatment for a relatively long period of time. See, Maillard, *Ana. Chim.*. Vol. 9, pp. 5 and 258 (1916); Hodge, *J. Agric. Food Chem.*, Vol. 1, p. 928 (1953); Bursten, *Food Chem.*, Vol. 6, p. 263 (1981) and Waller et al., *ACS Symp. Ser.* (1983).

After the tobacco composition has been subjected to the moderately high temperature treatment for the controlled period of time, the tobacco composition is collected. The tobacco composition is provided in various forms for use in the manufacture of smoking articles. For example, a heat-treated tobacco composition can be contacted with a liquid carrier such as glycerin, propylene glycol, ethanol, water, or the like, and employed as a form of tobacco in smoking article manufacture. Forms of heat-treated tobacco compositions can be applied directly to smokable materials. For example, tobacco cut filler, as well as the types of smokable materials described in U.S. Pat. No. 4,920,990 to Lawrence, et al., can be blended with about 0.01 to about 10 weight percent of the heat-treated tobacco extract, based on the weight of the smokable material. Heat-treated tobacco extracts can be applied to substrates (e.g., filter materials) as is described in U.S. Pat. application Ser. Nos. 606,287, filed Nov. 6, 1990 and 621,499, filed Dec. 7, 1990. Furthermore, the heat-treated tobacco composition (e.g., having the form of substrate and heat-treated tobacco extract) can be dried, combined with certain aerosol forming materials, and employed in the manufacture of those smoking articles described in U.S. Pat. Nos. 4,708,151 to Shelar; 4,771,795 to White, et al.; 4,714,082 to Banerjee, et al.; 4,756,318 to Clearman, et al.; 4,793,365 to Sensabaugh, et al.; 4,827,950 to Banerjee, et al.; 4,893,639 to White; 4,928,714 to Shannon; 4,938,236 to Banerjee, et al.; 4,938,238 to Barnes, et al.; 4,947,874 to Brooks, et al.; 4,955,399 to Potter, et al.; 4,991,159 to Lawrence, et al.; and 5,027,837 to Clearman, et al.; as well as U.S. Pat. application Ser. No. 642,233, filed Jan. 23, 1991. In addition, the heat-treated tobacco compositions can be incorporated into those smoking articles described in European Patent Publication Nos. 280,990 and 419,733.

The following examples are provided in order to further illustrate various embodiments of the invention but should not be construed as limiting the scope thereof. Unless otherwise noted, all parts and percentages are by weight.

EXAMPLE 1

An aged Burley tobacco in cut filler form is extracted in a stainless steel tank at a concentration of about 1 pound of tobacco per gallon of water. The extraction is conducted at ambient temperature (e.g., about 20° C.) while mechanically agitating the mixture over about a 1 hour period. The admixture is centrifuged to remove essentially all suspended solids. The aqueous extract is concentrated in a thin film evaporator to a concentration of about 30 percent dissolved solids. Thin film evaporation conditions are such that water is evaporated from the extract while loss of flavorful tobacco volatiles is minimized. The concentrated aqueous extract then is spray dried by continuously pumping the aqueous solution to an Anhydro Size No. 1 spray dryer. The dried powder is collected at the outlet of the dryer. The inlet temperature of the spray dryer is about 215° C., and the outlet temperature is about 80° C. The spray dried material is a brown, powdery material, and has a moisture content of about 5 percent to about 6 percent.

The spray dried extract is mixed with water. In particular, about 295 g of the extract is mixed with about 674 g of water. The resulting moist extract is contacted with about 28 g furaneol in a Parr Reactor Model No. 4522 equipped with a temperature control unit available as Parr No. 4842-PID from The Parr Instrument Co. As such, the resulting tobacco composition within the pressure vessel weighs about 997 g. The pressure vessel is equipped with a mechanical stirrer. The moist extract and additive then is subjected to exposure to a maximum temperature of about 180° C. and a maximum pressure of about 220 psig. The moist extract and additive is exposed to a temperature of about 140° C. to about 180° C. for about 60 minutes, during which time the pressure in the vessel ranges from about 40 to about 220 psig. Then, the mixture within the pressure vessel is cooled to room temperature, the vessel is depressurized, and the resulting liquid tobacco composition is removed from the pressure vessel. The tobacco composition exhibits an extremely dark brown color and a pleasant aroma.

EXAMPLE 2

Spray dried Burley tobacco extract is provided as described in Example 1. The spray dried extract is contacted with water. In particular, about 560 g of the extract is mixed with about 1404 g water. The resulting moist extract is contacted with about 36 g 2,3-pentanedione in the pressure vessel described in Example 1. The resulting tobacco composition then is subjected to exposure to a maximum temperature of about 175° C. at a pressure of about 530 psig. The moist extract and additive is exposed to a temperature of about 150° C. to about 175° C. for about 45 minutes, during which time the pressure in the vessel ranges from about 220 to about 530 psig. Then, the mixture within the pressure vessel is cooled to room temperature, the vessel is depressurized, and the tobacco composition then is removed from the pressure vessel. The tobacco composition exhibits an extremely dark brown color and a pleasant aroma.

EXAMPLE 3

Spray dried Burley tobacco extract is provided as described in Example 1. The spray dried extract is contacted with water. In particular, about 560 g of the extract is mixed with about 1384 g water. The resulting moist extract is contacted with 56 g 2,3-pentanedione in the pressure vessel described in Example 1. The resulting tobacco composition then is subjected to exposure to a maximum temperature of about 185° C. for about 30 minutes at a pressure of about 380 to about 510 psig. Then, the mixture within the pressure vessel is cooled to room temperature, the vessel is depressurized, and the tobacco composition then is removed from the pressure vessel. The tobacco composition exhibits an extremely dark brown color and a pleasant aroma.

EXAMPLE 4

Spray dried Burley tobacco extract is provided as described in Example 1. The spray dried extract is contacted with water. In particular, about 560 g of the extract is mixed with about 1404 g water. The resulting moist extract is contacted with about 36 g 2,3-butanedione in the pressure vessel described in Example 1. The tobacco composition then is subjected to exposure to a maximum temperature of about 180° C. and a maximum pressure of about 600 psig. The moist extract and additive is exposed to a temperature of about 160° C. to about 180° C. for about 50 minutes, during which time the presence in the vessel ranges from about 260 to about 600 psig. Then the mixture within the pressure vessel is cooled to room temperature, the vessel is depressurized, and the tobacco composition then is removed from the pressure vessel. The tobacco composition exhibits an extremely dark brown color and a pleasant aroma.

EXAMPLE 5

Spray dried Burley tobacco extract is provided as described in Example 1. The spray dried extract is contacted with water. In particular, about 525 g of the extract is mixed with about 1200 g water. The resulting moist extract is contacted with about 50 g maltol in the pressure vessel described in Example 1. The resulting tobacco composition then is subjected to exposure to a maximum temperature of about 180° C. at a pressure of about 430 psig. The moist extract and additive is exposed to a temperature of about 160° C. to about 180° C. for about 55 minutes, during which time the pressure in the vessel ranges from about 140 to about 430 psig. Then the mixture within the pressure vessel is cooled to room temperature, the vessel is depressurized, and the tobacco composition then is removed from the pressure vessel. The tobacco composition exhibits an extremely dark brown color and a pleasant aroma.

EXAMPLE 6

An aqueous Burley tobacco extract is provided essentially as described in Example 1, Part B of U.S. Pat. application Ser. No. 710,273, filed Jun. 4, 1991. However, the liquid extract is concentrated using the reverse osmosis unit described in the previously identified application to a concentration of about 12.5 percent tobacco extract and about 87.5 percent water. About 1470 g of the water and extract is mixed with about 31 g furaneol in the pressure vessel described in Example 1. The resulting tobacco composition then is subjected to exposure to a maximum temperature of about 180° C. for about 30 minutes at a pressure of about 140 to about 160 psig. Then, the mixture within the pressure vessel is cooled to room temperature, the vessel is depressurized, and the tobacco composition then is removed from the pressure vessel. The tobacco composition exhibits a pleasant aroma.

EXAMPLE 7

An aqueous Burley tobacco extract is provided as described in Example 6. In particular, about 1050 g of the water and extract is mixed with about 15 g 2,3-pentanedione, about 15 g furaneol and about 420 g of the spray dried Burley tobacco extract described in Example 1. The resulting tobacco composition then is subjected to exposure to a maximum temperature of about 180° C. for about 30 minutes at a pressure of about 220 to about 320 psig. Then, the mixture within the pressure vessel is cooled to room temperature, the vessel is depressurized, and the tobacco composition then is removed from the pressure vessel. The tobacco composition exhibits an extremely dark brown color and a pleasant aroma.

EXAMPLE 8

An aqueous Burley tobacco extract is provided as described in Example 1, Part B of U.S. Pat. application Ser. No. 710,273, filed Jun. 4, 1991. The liquid extract has a concentration of about 4.5 percent tobacco extract and about 95.5 percent water. About 1470 g of the liquid extract is mixed with about 30 g levulinic acid in the pressure vessel described in Example 1. The resulting tobacco composition then is subjected to exposure to a maximum temperature of about 180° C. for about 30 minutes at a pressure of about 160 to about 190 psig. Then, the mixture within the pressure vessel is cooled to room temperature, the vessel is depressurized, and the tobacco composition then is removed from pressure vessel. The tobacco composition exhibits a pleasant aroma.

EXAMPLE 9

An aqueous Burley tobacco extract is provided as described in Example 8. About 1485 g of the liquid extract is mixed with about 15 g 2,3-pentanedione in the pressure vessel described in Example 1. The resulting tobacco composition then is subjected to exposure to a maximum temperature of about 180° C. for about 30 minutes at a pressure of about 110 to about 130 psig. Then, the mixture within the pressure vessel is cooled to room temperature, the vessel is depressurized, and the tobacco composition then is removed from the pressure vessel. The tobacco composition exhibits a pleasant aroma.

What is claimed is:

1. A process for altering the chemical nature of tobacco extract, the process comprising the steps of:

(a) extracting tobacco material with an extraction solvent to provide a tobacco extract, (b) providing the tobacco extract within a liquid having an aqueous character such that the moisture content thereof is at least about 5 percent, based on the total weight of the solvent and extract, (c) contacting the tobacco with a substrate, and (d) subjecting the tobacco extract to heat treatment (i) in a pressure controlled environment, (ii) at a temperature above about 100° C., (iii) in the presence of a non-sugar compound selected from the group consisting of levulinic acid, furanones, pyranones, and alpha-dicarbonyl compounds.

2. The process of claim 1 whereby the extraction solvent is a liquid having an aqueous character.

3. The process of claim 1 or 2 including providing the tobacco extract in step (b) such that the moisture content thereof is at least about 15 percent.

4. The process of claim 1 or 2 whereby the extract is subjected to heat treatment at a temperature below about 250° C.

5. The process of claim 1 or 2 whereby the extract is subjected to heat treatment at a temperature above about 110° C.

6. The process of claim 1 or 2 whereby the extract is subjected to heat treatment at a pressure of about 10 psig to about 1,000 psig.

7. The process of claim 1 or 2 whereby the extract is subjected to heat treatment at a pressure of about 20 psig to about 500 psig.

8. The process of claim 1 or 2 whereby the extract is subjected to heat treatment at a pressure exceeding 100 psig.

9. The process of claim 1 or 2 whereby contacting the tobacco extract with a substrate of step (c) includes contacting the tobacco extract with an organic liquid.

10. The process of claim 9 whereby the extract is subjected to heat treatment at a pressure of about 10 psig to about 1,000 psig.

11. The process of claim 9 whereby the extract is subjected to heat treatment at a pressure of about 20 psig to about 500 psig.

12. The process of claim 9 whereby the extract is subjected to heat treatment at a pressure exceeding 100 psig.

13. The process of claim 9 whereby the organic liquid includes a polyhydric alcohol.

14. A process of altering the chemical nature of tobacco extract, the process comprising the steps of:

(a) extracting tobacco material with an extraction solvent to provide a tobacco extract, (b) providing the tobacco extract within a liquid having an aqueous character such that the moisture content thereof is at least about 5 percent, based on the total weight of the solvent and extract, (c) contacting the tobacco extract with an organic liquid, and (d) subjecting the tobacco extract to heat treatment (i) in a pressure controlled environment, (ii) at a temperature above about 100° C., and (iii) in the presence of a non-sugar compound selected from the group consisting of levulinic acid, furanones, pyranones, and alpha-dicarbonyl compounds.

15. The process of claim 14 whereby the extraction solvent is a liquid having an aqueous character.

16. The process of claim 14 or 15 including providing the tobacco extract is step (b) such that the moisture content thereof is at least about 15 percent.

17. A process for altering the chemical nature of a tobacco extract, the process comprising the steps of:

(a) extracting tobacco material with an extraction solvent to provide a tobacco extract, (b) providing the tobacco extract within a liquid having an aqueous character such that the moisture content thereof is at least about 5 percent, based on the total weight of the solvent and extract, (c) subjecting the tobacco extract to heat treatment (i) in a pressure controlled environment, (ii) at a temperature above about 100° C., and (iii) in the presence of a compound selected from the group consisting of levulinic acid, furanones, pyranones, and alpha-dicarbonyl compounds.

18. The process of claim 17 whereby the extraction solvent is a liquid having an aqueous character.

19. The process of claim 17 including providing the tobacco extract in step (b) such that the moisture content thereof is at least about 15 percent.

20. The process of claim 17 whereby the extract is subjected to heat treatment at a temperature below about 250° C.

21. The process of claim 17 whereby the extract is subjected to heat treatment at a temperature above about 110° C.

22. The process of claim 17 whereby the extract is subjected to heat treatment at a pressure of about 10 psig to about 1,000 psig.

23. The process of claim 17 whereby the extract is subjected to heat treatment at a pressure of about 20 psig to about 500 psig.

24. The process of claim 17 whereby the extract is subjected to heat treatment at a pressure exceeding 100 psig.

* * * * *

UNITED STATES PATENT AND TRADEMARK OFFICE

CERTIFICATE OF CORRECTION

PATENT NO. : 5,318,050

DATED : June 7, 1994

INVENTOR(S) : Alvaro Gonzalez-Parra et al.

It is certified that error appears in the above-indentified patent and that said Letters Patent is hereby corrected as shown below:

Col. 4, line 4, "tpbacco" should be --tobacco--.

Col. 6, line 65, "o" should be --of--.

Signed and Sealed this

Fourth Day of April, 1995

*Attest:*

*Attesting Officer*

BRUCE LEHMAN

*Commissioner of Patents and Trademarks*